United States Patent [19]

Ogawa

[11] 4,095,367

[45] Jun. 20, 1978

[54] ARTICULATED ROBOT ASSEMBLY

[75] Inventor: Iwakichi Ogawa, Kashiwa, Japan

[73] Assignee: Takara Co., Ltd., Tokyo, Japan

[21] Appl. No.: 694,161

[22] Filed: Jun. 9, 1976

[51] Int. Cl.[2] ..... A63H 13/02; A63H 11/00

[52] U.S. Cl. ..... 46/105; 46/106; 46/153; 46/163; 46/219; 46/266

[58] Field of Search ..... 46/104, 105, 264, 265, 46/266, 163

[56] References Cited

U.S. PATENT DOCUMENTS

| | | | |
|---|---|---|---|
| 630,850 | 8/1899 | Bowman | 46/104 |
| 1,261,528 | 4/1918 | Hess | 46/105 |
| 1,880,138 | 9/1932 | Hubl | 46/266 X |
| 3,128,575 | 4/1964 | Stanetyki | 46/105 X |
| 3,346,989 | 10/1967 | Ryan et al. | 46/116 X |
| 3,587,191 | 6/1971 | Cooper | 46/266 |
| 3,648,408 | 3/1972 | Terzian et al. | 46/104 X |
| 3,693,288 | 9/1972 | Lewis et al. | 46/163 X |
| 3,728,815 | 4/1973 | Tomiyama | 46/104 |
| 3,961,440 | 6/1976 | Saito | 46/202 X |

*Primary Examiner*—F. Barry Shay
*Attorney, Agent, or Firm*—Harold L. Jackson; Stanley R. Jones; Joseph W. Price

[57] ABSTRACT

An articulated doll figure, such as a robot, having removable appendages and capable of locomotion is provided. The robot figure is particularly adaptable to be separated into subcomponents to form individually or in conjunction with accessory items, independent toys. In this regard, a body or trunk member having an electrical motor is connected to appropriate power transmissions to provide rotational couplings on at least four separate positions on the trunk member plus directly driving an endless track drive pivotally mounted on the back of the trunk member. A lower torso portion can support another transmission assembly to provide sequential linear displacement motion in either branch of the legs. Lower leg members like the lower torso, are removable and each includes a roller assembly capable of coacting with a clutching member to provide unidirectional rotation. Each lower leg member can be mounted for connection with the torso transmission means to provide a walking motion for the robot. Alternatively, the lower leg member subcomponents can be divided to form independent vehicles. A storage cavity in the trunk member can support a smaller doll member for mounting on the subassemblies. The trunk member, itself, can operate independently as a subassembly with locomotion provided by the endless track drive. Each of the parts are dimensionally designed to coact with not only other parts of the robot figure, but other complimentary toy assemblies to further form independent sub-toy assemblies.

21 Claims, 9 Drawing Figures

FIG. 5
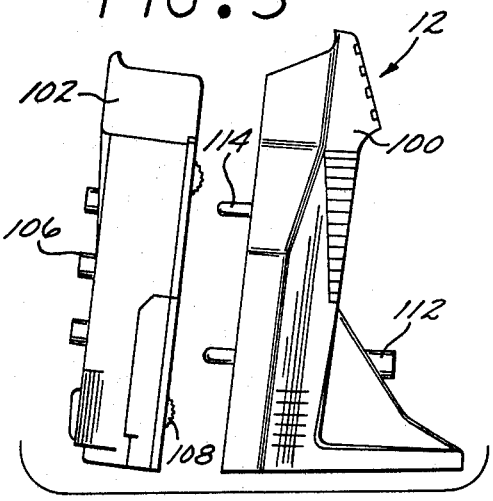
FIG. 6
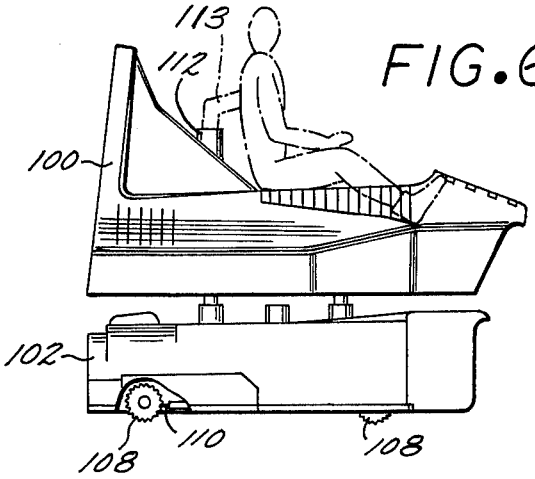
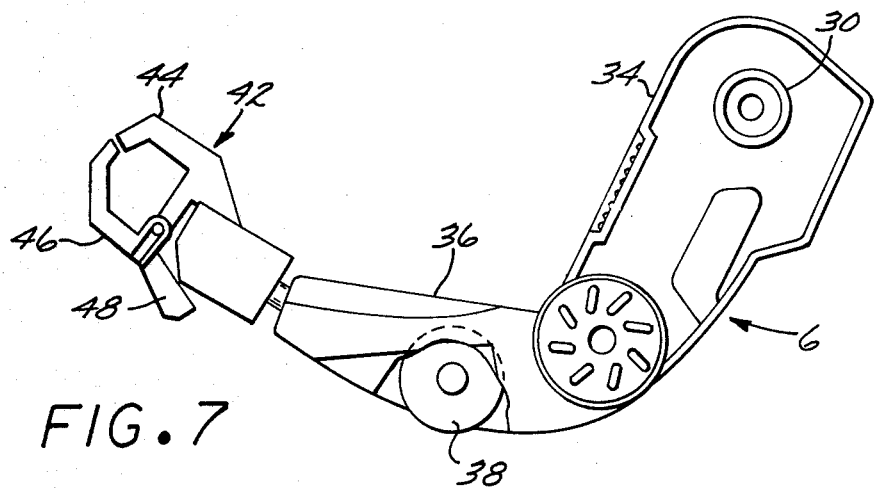
FIG. 7
FIG. 8
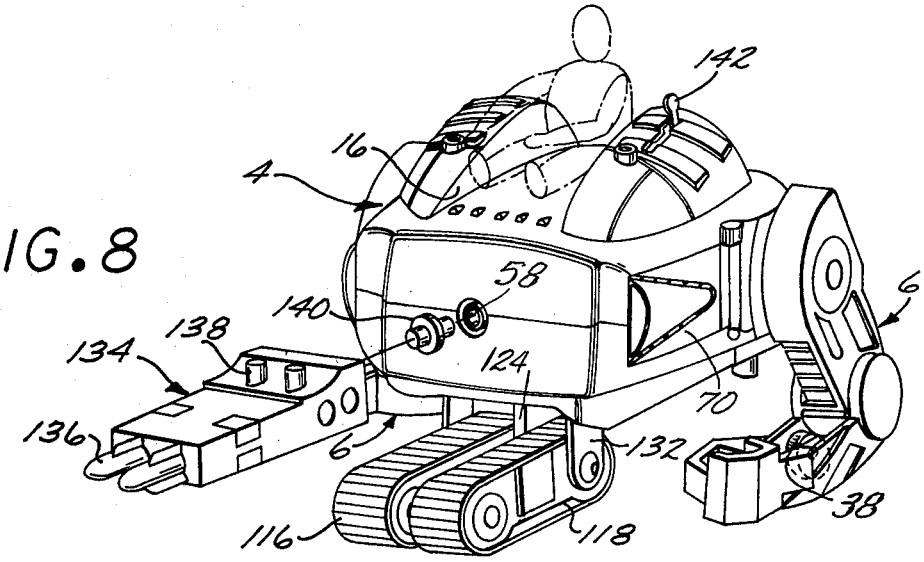

ARTICULATED ROBOT ASSEMBLY

BACKGROUND OF THE INVENTION

1. Field of the Invention

Present invention is directed to the toy industry and more particularly to a toy figure having removable appendages for forming subassemblies either alone or with other accessories.

2. Description of the Prior Art

The toy industry has provided a large number of toy doll assemblies having various degrees of independent locomotion and remote controlled motion. For example, U.S. Pat. No. 3,267,607 discloses a doll having a drive mechanism mounted in its torso for pivotally moving leg members. U.S. Pat. No. 3,038,275 describes a self-walking doll having individual motors in each foot which are alternately driven.

To date, the known prior art has not provided a robot assembly that is compatible with a line of complimentary toys and is capable of being broken into several subcomponents to form separate toy subassemblies.

SUMMARY OF THE INVENTION

The present invention is directed at providing a mechanical robot figure having limited locomotion and being capable of being disassembled into subcomponent toy assemblies either by itself or with additional accessories.

In this regard, a central trunk or body member is provided with a motor to drive a plurality of external power connections. The motor is also capable of driving an endless track pivotally mounted on the exterior of the trunk member. A pair of foot like appendages are removably connected to the trunk member through a power train in a lower torso member. The foot like appendages can be subdivided into separate parts to form an independent vehicle or to interconnect with the lower torso member to permit a walking movement of the robot figure in substantially only one direction. All the appendages can be removed from the trunk member and separate subassemblies can be interconnected to convert the trunk member into an independent vehicle. External power couplings are conveniently positioned within oversized bores that provide stationary connections for the various appendages.

The body member can further have a storage cavity for receiving a smaller doll that is compatible, for example with the vehicle chassis of the foot like appendage. Accessory items such as motors and like, can be interconnected to modify the basic structure of the mechanical robot figure into sub-toy assemblies. The arm appendages of the robot member include wheels capable of supporting the trunk member for independent locomotion with the endless track drive.

The features of the present invention which are believed to be novel are set forth with particularity in the appended claims. The present invention, both as to its organization and manner of operation, together with further objects and advantages thereof, may best be understood by reference to the following description, taken in connection with the accompanying drawings.

BRIEF DESCRIPTION OF THE DRAWINGS

FIG. 5 is a side exploded view of the leg member of the robot;

FIG. 6 is a side view of the leg member interconnected to form a vehicle;

FIG. 7 is a side view of the robot arm and,

FIG. 8 is a perspective view of the robot components forming a separate independent toy assembly.

DESCRIPTION OF THE PREFERRED EMBODIMENTS

The following description is provided to enable any person skilled in the toy industry to make and use the invention and it sets forth the best mode contemplated by the inventor of carrying out this invention. Various modifications, however, will remain readily apparent to those skilled in the above art, since the generic principals of the present invention have been defined herein specifically to provide a relatively economical and easily manufactured mechanical robot assembly.

Figure 1:
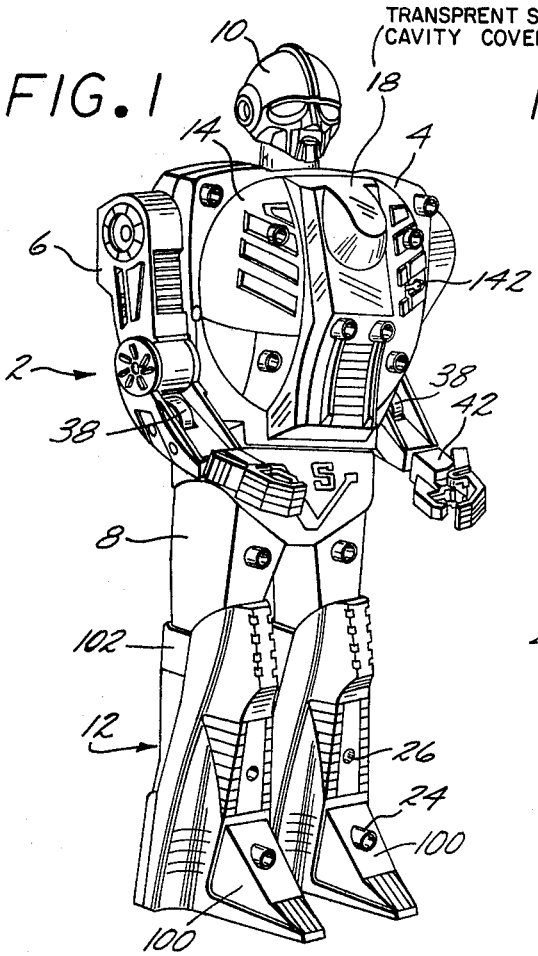
FIG. 1 is a perspective view of an assembled robot.

Referring to FIG. 1, a perspective view of an assembled robot is disclosed. The robot assembly includes a number of separate segments that can be individually utilized by themselves or in combination with accessories to provide subassembly toys. In this regard, the robot in FIG. 2 includes a trunk or body member 4 that is capable of containing both a power source and motor means. A pair of removable arms 6, are pivotally attached to the body member 4. Also removably attached to the body member 4, is a lower torso 8 and a head member 10. Leg members 12 can removably mount the lower torso 8 to provide a stationary base for upright support of the robot assembly.

Figure 3:
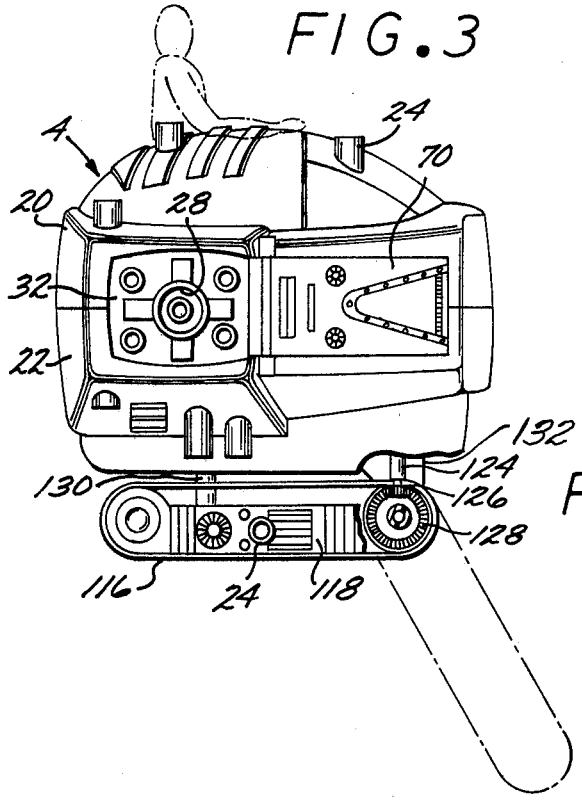
FIG. 3 is a side view of a subcomponent of the robot.

A protruding chest portion 14, of the body member 4, is split by a channel cavity 16, which can be covered by a translucent chest cover 18 to form a storage compartment for a supplemental smaller doll member. The doll member is appropriately proportioned and can be utilized as a central character or operator figure in a number of different separate toys and subassembled toys from the present robot figure. As can be seen in FIGS. 3, 6 and 8, the proportionate size of the articulated smaller doll will provide a criterion for the proportioning of the subassembly parts of the robot assembly, to permit a meaningful utilization of those parts in other combinations and by themselves as independent toys.

Figure 2:
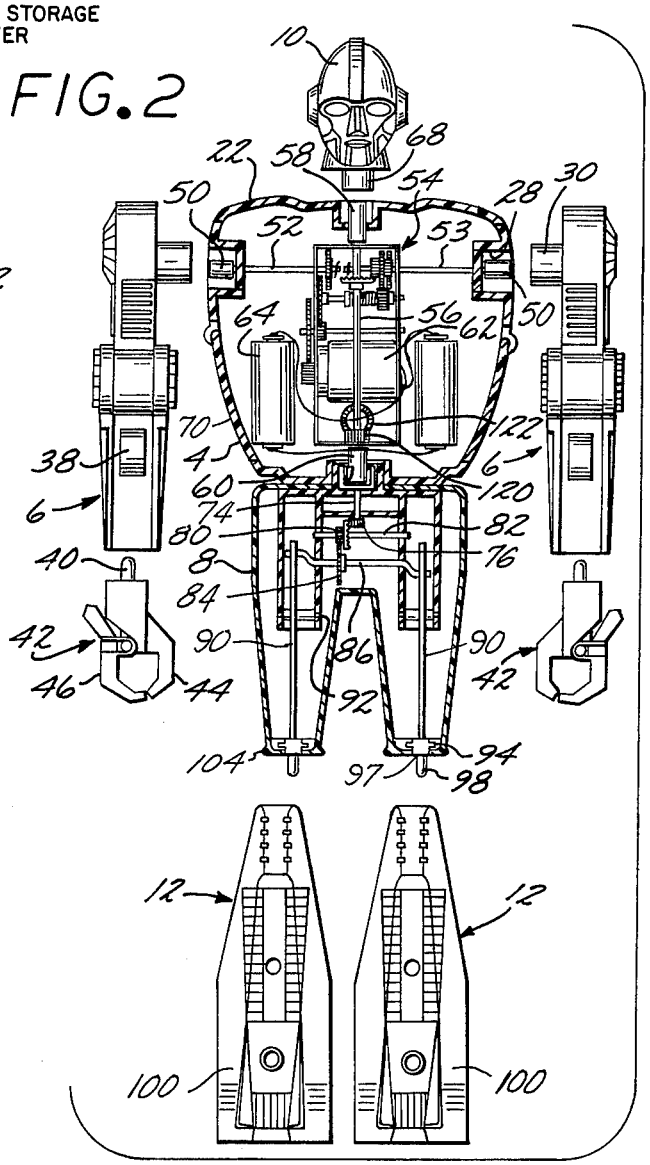
FIG. 2 is a schematic partial cross-sectional exploded view of the robot assembly with the body member and lower torso in cross sections.

Referring to FIG. 2, a partial cross-sectional exploded view of the robot is disclosed to show not only the relationship of the appendages such as the arms 6, head 10, and leg members 12, but further to disclose the power transmission arrangement both in the trunk member 4 and in the lower torso 8.

The trunk or body member 4 can be formed from a pair of molded half-shells 20 and 22. Preferably the robot figure is constructed primarily of plastic components for ease of manufacturing, although other materials could be utilized. The respective exterior surface configurations of the body shells 20 and 22, include a plurality of mounting sites 24 which form a female half of a coupling assembly for accessory attachments. The mounting sites 24 are positioned not only on the trunk or body member 4, but also on the lower torso 8 and the leg members 12. Additionally, other standardized bores or holes 26 are also mounted to provide connections of accessory items either directly through a male stud member, or indirectly through a supplemental coupling 13 as disclosed in phantom lines in FIG. 6.

The external configuration of the body shells 20 and 22 further provide simulated instruments to enhance the concept of control of the robot FIG. 2 by the smaller doll. The exact configuration of this decorative molding is, of course, subjective and can be varied within the parameters of the present invention.

In the embodiment of FIG. 1, the robot is fully assembled and is relatively stationary and not capable of locomotion. The arms 6 are pivotally mounted in oversized bores 28 through a friction fitting with a male hollow post 30 as can be seen in FIGS. 2 and 7. The hollow post 30 on each respective arm 6, is dimensioned to provide an interference fit with the oversized bores 28 in the mounting plates 32 captured between the body shells 20 and 22 as shown in FIG. 3. Each arm 6 comprises an upper arm 34 and a lower or forearm 36. They are pivotally interconnected by a yoke mounting with a screw capable of varying the frictional force exerted in the mounting between the upper arm 34 and the forearm 36. The forearm 36 includes a roller 38 rotatably mounted to extend slightly beyond the outside configuration of the forearm 36. A bore (not shown) at the extreme end of the forearm 36 is capable of frictionally retaining a male stud pin 40 mounted on the hand 42 or more appropriately, the grapple clamp. The grapple clamp 42 includes a stationary claw 44 and a pivotally movable spring biased claw 46. As disclosed in FIG. 7, the spring biases the movable claw 46 to a closed position, by exerting force on the lever 48 the grapple clamp 42 is opened and can receive and hold other objects, such as for example the small doll member. Grappling clamps or hands in doll like configurations are conventional as shown in U.S. Pat. No. 3,693,288.

The male hollow post 30 on each of the arms 6 has an appropriately sized bore to extend over and not engage a rotational coupling 50. Rotational couplings 50 can comprise a sleeve member having an internal bore of the same dimension as the holes or bores 26. Thus, accessories with appropriate male coupling studs can be mounted directly onto the rotational couplings 50 on either side of the body member 4.

Power shafts 52 and 53 are respectively connected through an appropriate transmission drive 54 to each of the rotational couplings 50 mounted in the arm sockets of the body member 4. For ease of illustration in FIG. 2, the transmission gear connections to shaft 52 which duplicate the connection to shaft 53 have not been shown. The transmission drive 54 can include a spring mounted drive gear to permit relative slippage as a safety feature if a power coupling is stalled. A traversely mounted power shaft 56 is also connected to the transmission drive 54 and terminates in a rotational coupling 58 at the top of the body member 4 and also a rotational coupling 60 at the bottom of the body member 4. A conventional electric motor 62, can provide the power when appropriately connected through a switch, in a convention manner, which connects the electric motor 62, with a pair of batteries 64. The respective batteries 64, are accessible on the side of the body member 4 through pivotally mounted lids 70 as can been seen in FIG. 8.

The lower rotational coupling 60 can be provided with wings or ears to facilitate a coupling with a lower torso power transmission drive 66. The head 10, as can be seen from FIG. 2, also includes a male hollow post 68 that can also be mounted, like the arm assemblies 6 to permit a free rotation of the upper rotational coupling 58.

Figure 4:
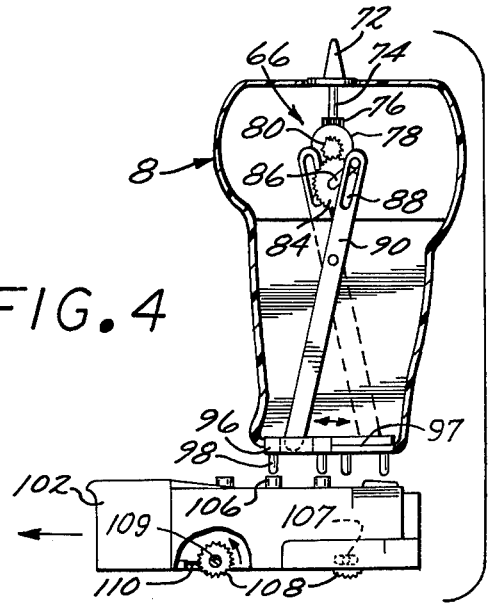
FIG. 4 is a cross-sectional view of the lower torso member of the robot.
Figure 9:
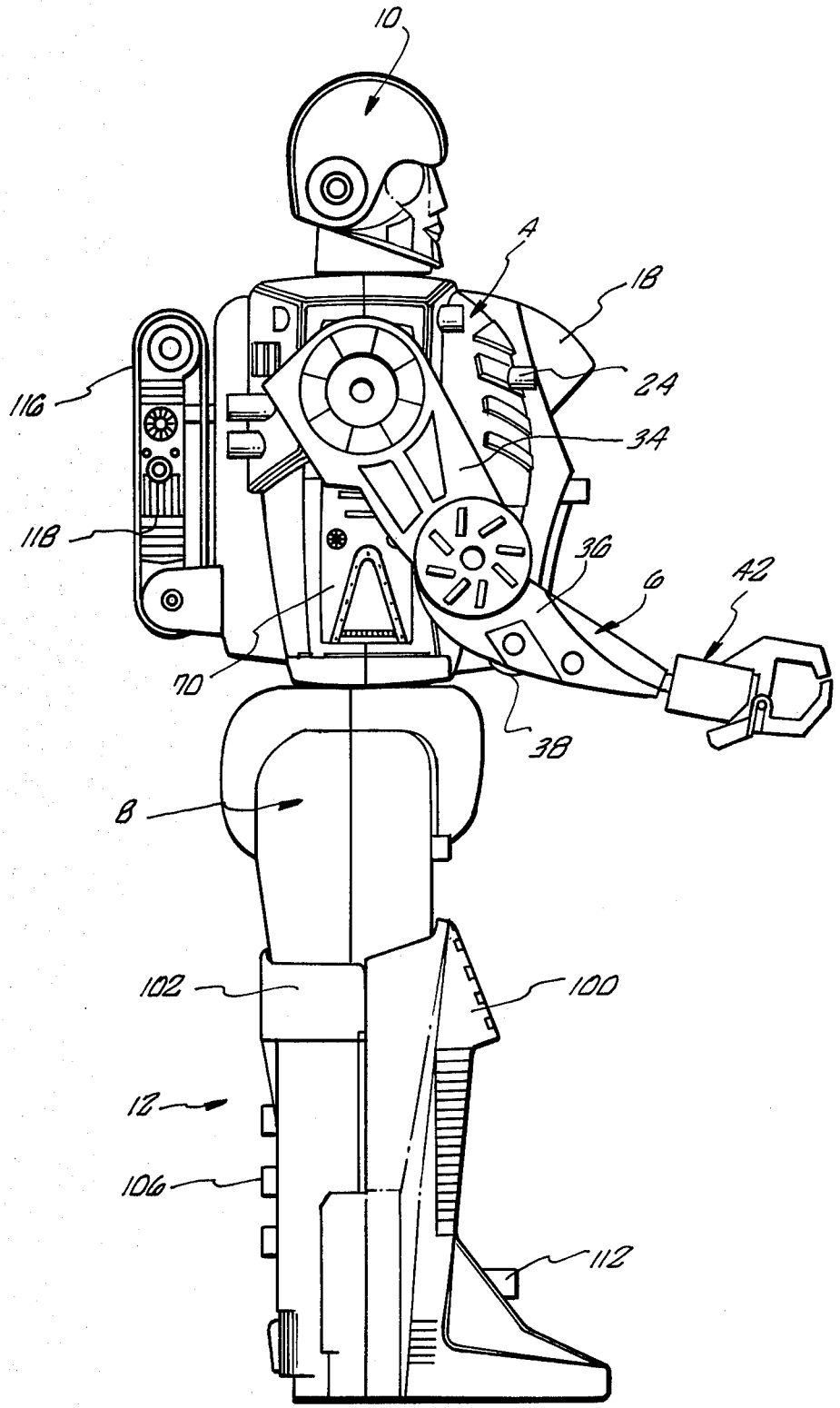

Referring specifically to FIGS. 4 and 2, the power transmission drive 66 for converting the rotational power of coupling 60 into a reciprocating linear movement to provide the simulation of walking by the robot figure is disclosed. The rotational power is transmitted from a male coupling 72 through a shaft 74 to a pinion gear 76 mounted on the shaft 74. The pinion gear drives a crown gear 78 that is interconnected with another pinion gear 80 mounted on a horizontal shaft 82. Pinion gear 80 directly drives a power gear 84 that is directly mounted on a shaft 86 terminating in a bell crank at either end of the shaft. The bell crank converts the rotational movement of the shaft 86 into a circular movement. The circular movement is converted into a linear movement by respective loss motion slots 88 in power levers 90. The respective power levers 90 are pivotally mounted on a shaft 92 and restrained by guide slots 94 in an opening 97 on the lower portion of the lower torso 8. Since the bell crank portions of the shaft 86 are 180° out of phase, one power lever 90 will be advancing as the other power lever 90 on the other side will be retracting. This linear movement can be effectively utilized to provide a walking motion for the robot FIG. 2, as will be described subsequently.

Connected to each of the power levers 90, at the bottom of the lower torso member 8, are respective guide plates 96 carrying appropriate peripheral rails for coaction with the guide slots 94. Male mounting studs 98 extend beyond the lower torso member 8 and are the same diametrical size as the bores in the mounting sites 24.

Referring to FIGS. 5 and 6, the leg members 12 are disclosed in a subassembly form. In this regard, the front or toe portion 100 has a chassis configuration of that of a vehicle, while the heel or the back leg portion 102 is not only designed to complement the front leg portion 100, but when reversed 180° can form the frame and wheel portion of a vehicle.

When the leg member 12 is assembled, an upward cavity is formed between the leg portions 100 and 102. The upper cavity includes a pair of mounting rails (not shown) which are capable of providing a snap connection with the lower peripheral rail members 104 on the bottom of the lower torso member 8. The cavity existing between the front leg portion 100 and the back leg portion 102, is capable of permitting a movement of the guide plates 96, free of any contact with the leg member 12. When the leg members 12 are split into a front leg portion 100 and a back leg portion 102, the back leg portion 102 is capable of being mounted as shown in FIG. 4, onto the guide plates 96 by the male studs 98, extending into the female mounting sites 106.

Each of the back leg portions 102 contain a pair of relatively wide rollers 108, having transverse parallel slots or treads about their peripheral. Each of the rollers 108, are mounted on shafts 109 held in position by an oblong mounting bore 107 on either side of the shaft as shown in FIG. 4. This mounting arrangement permits a limited longitudinal movement of the roller 108 relative to the longitudinal axis of the back leg portion 102. The purpose of this particular mounting is to provide a one-way clutch or brake mechanism whereby the rollers 108 can rotate freely in a counterclockwise direction, when removed to the right in the view since they are in the forward position within their mounting slots. When, however, the rollers 108 are attempted to be moved in a clockwise direction as shown in a partial view in FIG. 4, the entire roller 108 moves backward or to the left as shown in FIG. 4 to engage a braking stud 110 to prohibit clockwise movement.

The practical effect of this unidirectional roller assembly is to permit the sub-vehicle assembly shown in FIG. 6 to only be propelled in a forward direction. More importantly the assembly of FIG. 4 illustrates how the robot FIG. 2 is capable of walking by the ratchet like movement permitted by the rollers 108. Thus the power lever 90 can slide the guide plates 96 forward and advance the attached back leg portion 102. When the power lever 90 is forced by the crankshaft in an opposite direction, the rollers 108 lock on the braking studs 110 thereby forcing the translational movement of the power lever 90 to relatively advance the lower torso 8 in a forward direction. When each power lever 90, and its corresponding guide plates number 96 are mounted on back leg portions 102, the robot FIG. 2 will simulate a walking motion to provide a forward locomotion.

The front leg portion 100 has been specifically designed to provide a vehicle chassis and includes a mounting site 112 and male studs 114. The male studs 114 are designed to be mounted within appropriate bores (not shown) in the base of the back leg portion 102. The male studs 114 are also dimensioned to mount in the mounting sites 106 on the outside surface of the backleg portion 102 when forming a vehicle configuration. The front leg portion 100 is also adapted to be indirectly mounted to an auxiliary motor such as a spring powered motor (not shown) to provide an independently driven vehicle.

Referring specifically to FIGS. 2, 3 and 8 a pair of endless tracks 116 are rotatably mounted on a tractor frame 118 that is, in turn, pivotally mounted at one end of the back body shell 22 of the trunk or body member 4. A pinion gear is mounted on the vertical power shaft 56 and interconnects with a crown gear 122 on a power shaft 124. Another pinion gear 126 intermeshes with a bevel gear 128 which directly drives the rollers connected to the endless tracks 116. A spacing member 130 extends from the lower surface of the bottom body shell 22 to horizontally position the tractor frame 118 in an operative mode. Exterior mounting plates 132 provide a sufficient frictional fit with a tractor frame 118 to maintain whatever pivotal position that the tractor frame 118 is placed in, relative to the body shell 22.

FIG. 8 is illustrative of an independent sub-toy assembly that can be created from the component parts of the robot assembly 2. The endless track assembly can be rotated 180° from the position shown in FIG. 3 and the arms 6 can be appropriately cantilevered to permit the forearm rollers 38 to engage any surface. The chest cover 18 is removed and the doll figure can be mounted to simulate an operator. Other accessory mounting control units (not shown) could be mounted on the body member 4. For example, a spherical unit having a pivoted control seat mounted in its interior can be rotatably mounted on a C-shape frame and suspended above the body member 4.

A toy rocket assembly 134 carrying spring-loaded rockets 136, that can be fired by the control buttons 138, is mounted with the assistance of an intermediate coupling member 140 onto the body member 4. The switch 142 can provide an off, forward and reverse movement by reversing the polarity of the voltage applied to the electric motor 62.

In operation, a child can assemble the respective component parts into the robot FIG. 2. In this embodiment the switch 142 can be kept in an off position and the child can rotate the head 10 and the respective arms 6 and place objects within the grapple claimps 42. A smaller doll figure with pivotal articulated limbs can be placed within the chest cavity 16 and covered by a translucent chest cover 18. Accessory items such as the toy rocket assembly 134 can be attached to mounting sites throughout the robot FIG. 2. The grapple clamps 42 can be removed and accessories, such as the toy rocket assembly 134, can be mounted on the arm member 6. The head 10 and arms 6 can be removed and other accessories can be mounted appropriately onto the power rotational couplings 50 and 58, so that when the electric motor 62 is energized by the switch 142, a rotational movement will be provided to the accessory items. In this mode of operation, the endless tractor treads will be activated along with the lower torso power transmission drive. The output of the lower transmission drive 66 will be nullified by the lost motion mounting of the lower torso member 8 within the respective leg members 12.

By removing the leg members 12, and respectively dividing them into a front leg portion 100 and a back leg portion 102, the back leg portions 102 can then be appropriately connected as seen in FIG. 4 to the lower torso member 8. In this mode of operation the rotational power transmitted through the coupling 60 is converted by the power transmission drive into a reciprocating linear movement of the guide plates 96. As a result of the clutching assembly with its floating rotational mounting of the rollers 108 and their coaction with the braking stud 110, the robot figure will be giving a unidirectional locomotion.

A small man-like doll can be mounted within the chest cavity of the body member 4 and a child can pretend that the smaller doll is actually operating the robot FIG. 2.

Alternatively, a front leg portion 100 can be combined with the back leg portion 102 to form a vehicle as shown in FIG. 6. The doll or man figurine can be mounted with an appropriate 90° coupling member onto the mounting site 112 of the front leg portion 100 which is designed like a vehicle chassis. Obviously, each leg member 12 can form an individual vehicle.

The trunk or body member 4 that contains the motor means can be advantageously utilized as a vehicle by itself or in combination with other accessories as seen in FIG. 3. By placing the body member 4 on its back, that is with the body shell 22 adjacent to a surface, the endless tractor treads 116 can drive the body member 4 as an independent vehicle. In this regard the small doll can be mounted in the chest cavity 16 and the appropriate molded surface configuration can simulate control instruments that are of appropriate size for that of the small doll figure. As can be readily appreciated, the power couplings 50 on either side and the upper power coupling 58 and the lower power coupling 60 are readily adaptable to receive accessory items such as; a helical screw, stars, propellers, scoops or buckets, rocket assemblies, etc.

Likewise the chest cavity 16 with the mounting sites 24 are capable of receiving subassembly control modules (not shown). As can be readily envisioned, the vehicle chassis front leg portions 100 can be easily mounted through one of their male studs 114 and a mounting site 24 to provide another vehicle form. Also the grappling clamps 42 can be appropriately mounted within the exterior power couplers to provide a vehicle with a gripping member.

The combinations possible are figuratively limited only by the child's imagination and the accessories purchased. For example, while not shown, it is possible to provide an accessory unit consisting of a basic body member providing a cockpit with instrument panels dimensioned to fit the operator doll. Attached on either side of the body member can be a blade or bucket reminiscent of a bulldozer blade. Likewise, a front blade like a bulldozer can be positioned on the front of the body member. The studs for each of the accessory component parts that are removably attached to the body member are advantageously of the same size as that used on the robot figure mounting sites. Accordingly, the body member can be mounted within the chest cavity 16 to provide an elevated control module and the respective side buckets or shovels can be rotatably mounted on the side power couplings 50. The front blade can of course be mounted on either the upper coupling 58 or the lower coupling 60. Whether the accessory items will rotate depends on whether it is desirable to mount directly onto the rotational couplings or onto the oversized bores that surround each coupling. With the body member 4 placed on its back to render the endless tractor treads 116 operable, the child can easily create a mobile tractor.

Since numerous accessories can be combined with the present invention and the design characteristics can be subjectively varied by a person skilled in the prior art, the present invention should be measured solely from the following claims in which I claim:

1. A detachable robot toy assembly comprising;

a hollow trunk member;

motor means mounted in the trunk member;

a plurality of output power coupling means operatively connected to the motor means and mounted in positions about the trunk member;

a detachable lower torso member capable of being removably attached to one of the power coupling means and including a transmission means for receiving power from the power coupling means and translating it into a locomotive power output; and at least one support appendage removably attached to the lower torso member in one aligned position to provide a stationary support of the robot toy assembly regardless of the activation of the lower torso transmission means, the support appendage further having means which, when connected in another aligned position with the lower torso member power output, will provide locomotion to the toy assembly whereby the hollow trunk member can be removed from the lower torso member and operated independently to provide power to accessory items appended to its output power coupling means and further can be combined with the lower torso member and support appendage in a stationary mode of operation or with the lower torso member and said appendage means in a locomotion mode of operation.

2. The invention of claim 1 further including means for pivotally interconnecting at least some of the appendages to the trunk member about the power means to permit free rotation of the power coupling means.

3. The invention of claim 1 further including a storage cavity on the trunk member and a transparent cover extending over the storage cavity.

4. The invention of claim 1 further including a pair of foot appendages for connecting with the transmission means, each foot appendage having a uni-rotational braking assembly.

5. The invention of claim 1 wherein the support appendage has a first chassis part and a second frame part, first connection means on the first chassis part, and second connection means on the second frame part to coact with the first connection means to combine the respective parts into a configuration simulating a portion of a leg, the respective parts providing at one end a coupling configuration between them to removably attach the lower torso member.

6. The invention of claim 5 wherein the frame part supports the means for providing locomotion which further includes a substantially unidirectional roller assembly.

7. In an articulated humanoid figure having removable appendages, the improvement comprising;

a hollow trunk member having a simulated upper shoulder portion and a lower body portion;

motor means mounted in said trunk member;

at least a pair of power trains connected to said motor means and extending through said trunk member to provide exterior power connections in at least four separate positions on said trunk member, and coupling means provided at each separate power connection whereby auxiliary items and at least some of said appendages can be optionally connected to said trunk member and driven by said motor means, further including at least a pair of said appendages having simulated arm configurations being connectable at said shoulder portion of said trunk member and respectively including a roller member rotatively mounted thereon, the periphery of the respective roller member projecting from the arm configuration sufficiently to allow it to roll over a surface supporting at least a portion of said humanoid figure.

8. The invention of claim 7 further including an endless track drive assembly operatively mounted on the trunk member.

9. The invention of claim 7 further including a rocket assembly for shooting rocket-like projectiles.

10. The invention of claim 7 further including a grapple clamp assembly connected to at least one said arm appendage.

11. In a toy robot assembly having a plurality of removably attached body component parts, the invention comprising;

a hollow simulated body trunk member having at least a configured chest and back portion;

motor means mounted in the trunk member;

a plurality of output power coupling means operatively connected to the motor means and positioned about the trunk member and capable of driving appended parts;

an endless track drive assembly operatively mounted on the back portion and connected to one of the output power coupling means to drive the track drive assembly, which in turn can drive the body trunk member when it is placed on its back portion, and a pair of separate support appendages having respectively simulated configurations of at least a portion of a leg removably connected to and supporting the toy robot assembly, said support appendages being capable of supporting the body trunk member in a stationary upright position, portions of each said support appendage including roller means for providing rotational movement in substantially only one direction when the roller means are operatively connected to one of said output power coupling means whereby the toy robot can be provided with locomotion in substantially one direction while the body trunk member is likewise supported in an upright position.

12. The invention of claim 11 further including removable transmission means for receiving power from output power coupling means and translating it into a linear reciprocating movement.

13. The invention of claim 11 wherein the endless track drive assembly is pivotally mounted on the trunk member.

14. The invention of claim 11 further including a lower torso member interconnecting the support appendages and the trunk member.

15. The invention of claim 14 wherein each support appendage has a first vehicle chassis part and a second frame part, the respective appendages are removably connected together to form a snap connection cavity therebetween to coact with a portion of the lower torso member.

16. The invention of claim 15 wherein the roller means are mounted on a side of the frame part facing the vehicle chassis part when they are configured to provide a stationary support.

17. In an articulated doll figure such as a robot toy having a simulated head, arm and leg appendages, the improvement comprising:

a simulated body trunk member having the configuration of a chest and back and appropriately capable of supporting the head, arm and leg appendages;

motor means for providing power operatively connected to the body trunk member including an output power coupling means on the back of the body trunk member;

pivotal mounting means on the back of the body trunk member, and an endless track drive assembly connected at one end to the pivotal mounting means and the output power coupling means to drive the track of the drive assembly, the endless track drive assembly being rotatable about the pivotal mounting means to assume various drive configurations relative to the body trunk member.

18. The invention of claim 17 further including at least a pair of appendages of a vehicle chassis configuration.

19. The invention of claim 18 wherein the vehicle chassis configuration appendages include a first and second member, the first member forms a body of the vehicle chassis and the second member forms a frame with wheels.

20. The invention of claim 17 further including at least a pair of appendages, having an arm configuration and including a roller member.

21. The invention of claim 17 wherein at least a pair of appendages have respective wheel assemblies for supporting the trunk member when driven by the endless track drive.

* * * * *

UNITED STATES PATENT AND TRADEMARK OFFICE

CERTIFICATE OF CORRECTION

PATENT NO. : 4,095,367

DATED : June 20, 1978

INVENTOR(S) : Iwakichi Ogawa

It is certified that error appears in the above-identified patent and that said Letters Patent are hereby corrected as shown below:

Column 3, line 2, delete "13" and insert --113--.

Column 3, line 62, delete "been" and insert --be--.

Column 7, Claim 2, line 64, insert --coupling-- between "power" and "means".

Signed and Sealed this

Sixth Day of March 1979

[SEAL]

*Attest:*

RUTH C. MASON
*Attesting Officer*

DONALD W. BANNER
*Commissioner of Patents and Trademarks*